US005370335A

United States Patent [19]

Vigneau

[11] Patent Number: 5,370,335

[45] Date of Patent: Dec. 6, 1994

[54] SURFACE REWINDER AND METHOD

[75] Inventor: Richard J. Vigneau, Green Bay, Wis.

[73] Assignee: Paper Converting Machine Company, Green Bay, Wis.

[21] Appl. No.: 19,074

[22] Filed: Feb. 18, 1993

[51] Int. Cl.[5] ..... B65H 18/16

[52] U.S. Cl. ..... 242/542.1

[58] Field of Search ..... 242/562, 66

[56] References Cited

U.S. PATENT DOCUMENTS

| | | | |
|---|---|---|---|
| 2,901,191 | 8/1959 | Phelps | 242/66 |
| 4,327,877 | 5/1982 | Perini | 242/66 |
| 4,496,112 | 1/1985 | Olsson et al. | 242/66 |
| 4,828,195 | 5/1989 | Hertel et al. | 242/66 |
| 4,842,209 | 6/1989 | Saukkonen | 242/66 X |
| 4,909,452 | 3/1990 | Hertel et al. | 242/56 R |
| 4,962,897 | 10/1990 | Bradley | 242/66 X |
| 5,031,850 | 7/1991 | Biagiotti | 242/66 |
| 5,104,055 | 4/1992 | Buxton | 242/66 |

*Primary Examiner*—Daniel P. Stodola
*Assistant Examiner*—Eileen A. Dunn
*Attorney, Agent, or Firm*—Tilton, Fallon, Lungmus & Chestnut

[57] ABSTRACT

A surface rewinder and method wherein a three drum cradle includes spaced apart first and second winding drums and wherein the speed profile of the second winding drum is controlled to substantially eliminate slippage between the second winding drum and a web being wound on a core by increasing the speed of the second drum after passage between the space as a function of the increasing diameter of the roll being wound.

6 Claims, 1 Drawing Sheet

SURFACE REWINDER AND METHOD

BACKGROUND AND SUMMARY OF INVENTION

This invention relates to a surface rewinder and method and, more particularly to a rewinder wherein the operation of one of the winding rolls features a unique speed profile.

In the past, two basic types of surface rewinders have been available commercially. One type of surface rewinder is seen in co-owned U.S. Pat. No. 4,909,452 and features a movable winding drum. More particularly, the transition of the core and partially wound product from one side of the nip of the winding drums to the other is done with a combination of lower drum movement, infeed transfer finger exposure and speed differential between the two drums. At the beginning of the cycle the distance between the two winding drums is very quickly dropped. The infeed transfer fingers are then proportionately exposed and this, along with a small speed differential between the drums, drives the product from one side of the drums' nip to the other. This allows the diameter of the product to build and move through the transition from one side to the other without additional compression.

Another surface rewinder can be seen in U.S. Pat. No. 4,327,877. This uses a speed change of one of the rolls to quickly move the core and product partly wound thereon from one side of the pair of winding rolls to the other. This method compresses the product while the speed change advances the product. In operation, the lower drum speed quickly slows by controlled deceleration and then returns to and maintains a constant speed differential through the remainder of the wind cycle.

In each case, there is a degree of dependency on slippage between the product and the surfaces in contact therewith. If the drum surfaces are smooth enough to allow slippage, they also permit unstable products (typically soft rolls) which easily bounce around in the three drum winding area limiting the speed at which they can be run.

According to the invention, the three drum cradle includes spaced apart first and second winding drums with control means operably associated with the drums for changing the rotational speed of one drum to substantially eliminate slippage and also provide a speed profile in this drum wherein the speed of the drum is decreased in the beginning of each winding cycle to advance a partially wound roll through the space between winding drums and thereafter increasing the speed of the specific drum as a function of the increasing diameter of the partially wound roll. Other objects and advantages of the invention may be seen in the details of construction and operation set forth in the ensuing specification.

BRIEF DESCRIPTION OF THE DRAWING

The invention is described in conjunction with the accompanying drawing, in which.

DETAILED DESCRIPTION

Figure 1:
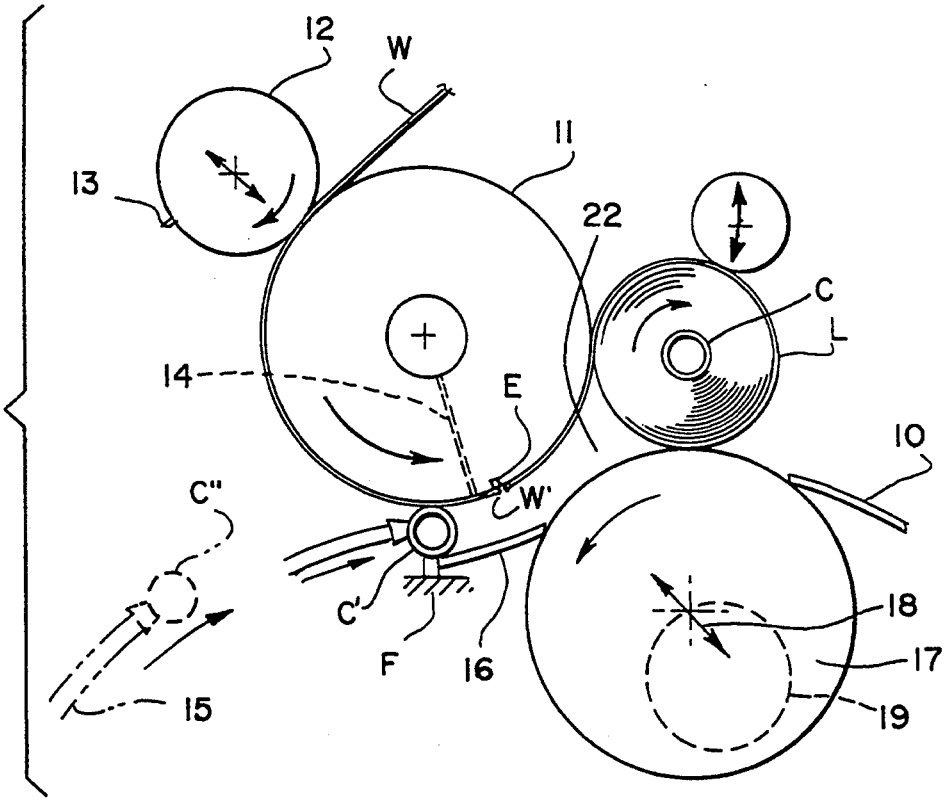
FIG. 1 is a schematic side elevational view of a surface rewinder incorporating teachings of the instant invention.

In the illustration given and with reference first to FIG. 1, a typical three drum cradle is illustrated which is suitably mounted on a frame F—only part of which is illustrated in the lower central portion of FIG. 1. In conventional fashion, a pair of side frames (not shown) are provided which support the various drums and other rotatable members in rotatable fashion.

Starting at the upper left central portion of FIG. 1, the symbol W designates a web which is to be rewound from a parent roll (not shown) into a log L—see the right central portion of FIG. 1. The log L has a diameter of the normally experienced toilet tissue or toweling rolls and consists of a number of layers of convolutely wound web W on a central core C. The core C in position C′ is shown in pre-wound condition and corresponds to the beginning of the winding cycle. At the end of the winding cycle, the log L is discharged along a ramp 10 for further processing—usually sawing the same transversely into retail size roll lengths.

Now turning to the upper left portion of FIG. 1, the numeral 11 designates a bedroll on which the web W is partially wrapped and also constitutes the first winding drum. Arranged on the frame F on the side of the web opposite to the first winding drum 11 is a knife roll 12 equipped with a knife 13 for coaction with the bedroll 11 in order to transversely sever the web incident to the end of one winding cycle and the beginning of another winding cycle. The web W has a leading edge which is engaged by a vacuum port 14 (in this showing) to make sure that the leading edge of the now-severed web conforms to the periphery of the first winding drum 11 until transfer occurs to the glue equipped core C′.

As shown in the lower left portion of FIG. 1 is the core C″ being maintained on an inserting means 15 which moves in a generally arcuate path to the solid line position wherein the core is designated C′. At this point, to the core C′ encounters a stationary plate 16 which is analogous to that seen in co-owned U.S. Pat. No. 4,909,452. By virtue of the core C′ engaging both the rotating surface of the first winding roll 11 and the stationary surface of the plate 16, the core C′ is caused to rotate on the plate 16 and move to the right in FIG. 1. As the core C′ moves to the right its glue-equipped surface engages the web W adjacent the leading edge E thereof and begins the wind ultimately coming into contact with the lower or second winding drum 17. This second or lower winding drum 17 is mounted for movement at least away from the first winding drum 11 although the invention may be practiced to advantage with the center distances between the two drums being constant, i.e., the spacing between the drums 11 and 17 remaining constant. In the event movement is employed, it may either be a pivotal or reciprocating type movement as indicated by the double ended arrows 18 or in a closed loop shown in dotted line as at 19. For this purpose, suitable means (not shown) are provided on the frame F and they may be advantageously of the type seen in co-owned U.S. Pat. No. 4,848,195.

OPERATION

In the operation of the invention, the web W is unwound from a source such as a jumbo parent roll and proceeds as illustrated on the surface of the rotating first drum 11, being transversely severed by the knife 13 on the knife roll 12. Thereafter, the leading edge of the now-severed web encounters the core C′ and is wound thereon first as the core C' travels to the right on stationary plate 16 and thereafter on the surface of the winding drum 17.

Figure 2:
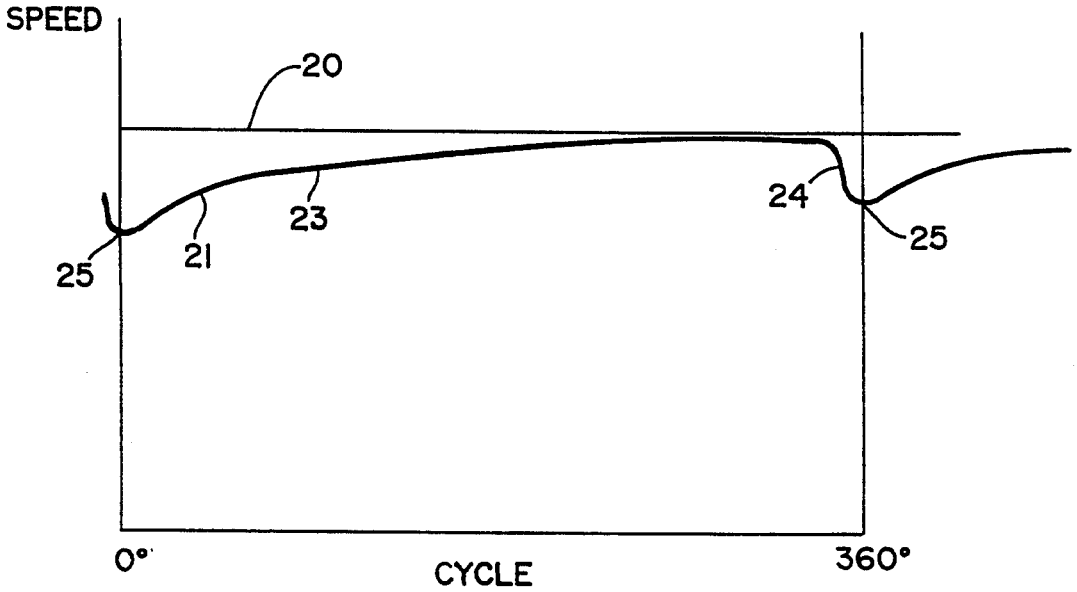
FIG. 2 is a graph of the speed profile developed in one of the winding rolls according to the teachings of this invention.

At the beginning of the winding cycle which is designated 0° at the left end of the abscissa entitled CYCLE in FIG. 2, the speed of the second winding drum 17 is relatively slow in comparison with the constant speed 20 of the first winding drum 11. This lower drum speed 21 increases fairly rapidly over the initial part of the wind so as to propel the now partially wound roll through the space 22 between the first and second winding drums 11, 17. Thereafter, the speed of the second winding drum follows a path designated 23 which approaches but does not precisely equal the surface speed of the first winding roll and which increases as a function of the increasing diameter of the partially wound roll. Then, at the end of the cycle or close thereto, the speed of the second winding roll (the lower roll shown herein) drops as rapidly as possible so as at 24 so as to be ready to start another winding cycle as at 25 (see both ends of the plot of FIG. 2).

Inasmuch as slippage can be substantially eliminated, it is possible to equip the outer surfaces of one or both of the winding drums 11, 17 with non-slip material without damaging the web W.

While in the foregoing specification a detailed description of an embodiment of the invention has been set down for the purpose of illustration, many variations in the details hereingiven may be made without departing from the spirit and scope of the invention.

I claim:

1. A surface rewinder for continuously winding convolutely wound web rolls comprising a frame, a three drum cradle rotatably mounted on said frame and including spaced apart first and second winding drums and a rider drum, means on said frame for rotating each of said drums, the first winding drum being rotated at a predetermined speed, core introducing means on said frame for moving a core toward the space between said first and second winding drums, means for continuously introducing a web into contact with said core being moved toward said space for cyclically winding said web on cores sequentially, control means operably associated with said frame for changing the rotational speed of said second winding drum to substantially eliminate slippage between said second winding drum and a web roll being wound on said core and also provide a speed profile in said second winding drum wherein the speed of said second winding drum is decreased just prior to the beginning of each winding cycle to advance a partially wound roll toward and through said space and thereafter increasing the speed of said second winding drum as a function of the increasing diameter of said partially wound roll to a speed less than said predetermined speed.

2. The rewinder of claim 1 in which said frame is equipped with means for moving said second winding drum during each cycle of winding.

3. The rewinder of claim 2 in which said means moves said second winding drum through a closed path.

4. The rewinder of claim 1 in which said second winding roll has a cylindrical outer surface, said surface being equipped with non-slip material.

5. A method for convolutely winding web rolls comprising providing a three drum cradle rotatably mounted on a frame and including spaced apart first and second winding drums and a rider drum, rotating said first winding drum at a predetermined speed, rotating said second winding drum, moving a core toward the space between said first and second winding drums, and controlling the rotational speed of said second winding drum to substantially eliminate slippage between said second winding drum and a web roll being wound on said core and also provide a speed profile in said second winding drum wherein the speed of said second winding drum is decreased just prior to the beginning of each winding cycle to advance a partially wound roll toward and through said space and thereafter increasing the speed of said second winding drum as a function of the increasing diameter of said partially wound roll to a speed less than said predetermined speed.

6. The method of claim 5 in which said second winding drum is moved during each winding cycle to change the space between said first and second winding drums.

* * * * *